United States Patent [19]

Loofbourow

[11] 3,950,958

[45] Apr. 20, 1976

[54] REFRIGERATED UNDERGROUND STORAGE AND TEMPERING SYSTEM FOR COMPRESSED GAS RECEIVED AS A CRYOGENIC LIQUID

[76] Inventor: Robert L. Loofbourow, 3601 Park Center Blvd., Room 225, St. Louis Park, Minn. 55416

[22] Filed: Oct. 29, 1974

[21] Appl. No.: 518,400

Related U.S. Application Data

[63] Continuation-in-part of Ser. No. 119,623, March 1, 1971, Pat. No. 3,848,427.

[52] U.S. Cl. ..... 62/45; 61/.5; 62/260; 48/190; 137/236; 165/45

[51] Int. Cl.[2] ..... F17C 1/00

[58] Field of Search ..... 61/.5; 62/45, 50, 51, 62/52, 54, 55, 260; 137/236; 165/45; 48/190

[56] References Cited

UNITED STATES PATENTS

| | | | |
|---|---|---|---|
| 2,316,495 | 4/1943 | White | 62/52 |
| 2,550,844 | 5/1951 | Meiller et al. | 48/190 |
| 2,810,263 | 10/1957 | Raymond | 61/.5 |
| 2,932,170 | 4/1960 | Patterson et al. | 61/.5 |
| 3,232,725 | 1/1966 | Secord et al. | 48/190 |
| 3,298,805 | 1/1967 | Secord et al. | 48/190 |

*Primary Examiner*—William F. O'Dea
*Assistant Examiner*—Ronald C. Capossela
*Attorney, Agent, or Firm*—Burd, Braddock & Bartz

[57] ABSTRACT

Methods and systems for storing large volumes of gas, such as natural gas, commonly shipped as liquid at very low temperature and unloaded through comparatively short cryogenic pipelines. Systems are disclosed for receiving, storing and warming shipments of liquefied gas prior to distribution to consumers. The systems include invisible underground storage as a safeguard against natural and artificial hazards and to utilize natural heat flow to warm the gas.

15 Claims, 5 Drawing Figures

PVT RELATIONSHIPS OF METHANE

REFRIGERATED UNDERGROUND STORAGE AND TEMPERING SYSTEM FOR COMPRESSED GAS RECEIVED AS A CRYOGENIC LIQUID

This application is a continuation-in-part of my copending application Ser. No. 119,623, filed Mar. 1, 1971, for STORAGE OF GAS IN UNDERGROUND EXCAVATIONS, now U.S. Pat. No. 3,848,427, issued Nov. 19, 1974.

This invention relates to methods and systems for receiving, storing and warming shipments of liquefied gas and more particularly to the storage of such gas in underground chambers at near critical conditions. Various gases, of which natural gas is an example, are commonly shipped as liquid at very low temperature and unloaded through comparatively short cryogenic pipelines. Because of its density, liquid natural gas is shipped effectively in marine tankers and tank cars and trucks, but at atmospheric pressure it can be kept liquid only at about −260° F or below. Because of the high cost of keeping tankers idle, they should be unloaded rapidly for re-use. However, the liquid has to be regasified and warmed to at least about −40° F, or more commonly up to 32° F before it goes into an ordinary pipeline. The rate of gas consumption varies with the outside temperature and, as it seems inevitable that an increasing part of the available gas must be used for space heating, the variation will increase. For efficiency, however, gas should be produced, liquefied and shipped at a uniform rate. One purpose of this invention is to accommodate these diversities in the safest, the most efficient, and the most acceptable manner.

The systems of this invention utilize underground storage chambers. The "storage tanks" are invisible. Cover of more than 1,000 feet of rock provides the best possible protection against the natural and artificial hazards associated with gas storage. Natural heat flow is used to warm the gas. Design elements, such as the size, proportions and relative positions of various heat exchanging chambers, permit choice of a built-in capacity for heat exchange. Provision to route gas in various ways through these chambers and outside heat exchangers permits control to meet varying requirements. Gas can be received and delivered at rates set almost entirely by the capacity of pumps and pipelines. Where conditions are favorable, both capital and operating costs can be attractive.

Thermodynamically, the critical temperature of a gas is the temperature above which it cannot be liquefied at any pressure. The critical pressure is the pressure of the saturated vapor at the critical temperature or the pressure at which the gas and liquid coexist at the critical temperature. Gases and their mixtures deviate from the classic gas laws (which show the relation between pressure, volume and temperature for an imaginary "perfect" gas) in that under some conditions more gas can be stored in a unit space than the gas laws indicate. This deviation and its rates of change are most favorable to gas storage at the critical temperature and pressure.

The "compressibility factor" of a gas is the measure of this deviation. For various elemental gases and gaseous chemical compounds, each at its critical temperature and pressure, the compressibility factor is between 0.3 and 0.19, that is, the volume of space occupied by a unit volume of gas at critical conditions is between 0.19 and 0.30 of the volume which a "perfect" gas would ocupy at the same temperature and pressure.

The present invention is directed to the utilization of these properties for the advantageous storage of gases and mixtures of gases under economically feasible conditions. The principal object of this invention is to provide a safe, efficient storage system for large volumes of common and economically useful gases which can be built underground. The invention is directed especially to the storage of large volumes of pure or mixed gases having critical temperatures lower than the freezing point of water. Data for some of these gases are shown in Table I, appended.

The invention is illustrated in the accompanying drawings in which corresponding parts are identified by the same numerals and in which.

Other known receiving terminals utilize highly insulated exposed tanks of special materials and construction to receive and store liquid gas at near atmospheric pressure. Part of the gas is burned to regasify and warm gas to be sent out. Because these storage tanks are above ground and exposed and comparatively small, and because most known "natural" underground storage fields are distant from both seaboard terminals and the larger markets, a large part of the gas may have to be sent through pipelines to storage and then to market. This invention provides a means of receiving gas from tankers at high rates and storing huge quantities of gas without the inflexible requirement of extreme low temperature. It provides for warming the gas gradually by natural heat flow. It provides a type of storage facility which can be built at sites near the sea and also near large markets. The security of the storage provided is comparable to that of "natural" storage fields. Its use protects against diasters such as those which have resulted from the storage of liquefied natural gas in exposed tanks.

The percentage of methane in natural gas is generally more than 85% and may be 95% or more. For purposes of illustration, methane is used as an example, but it is evident that the same means can be used to store other gases, including those shown in Table I and others of similar properties.

Figure 1:
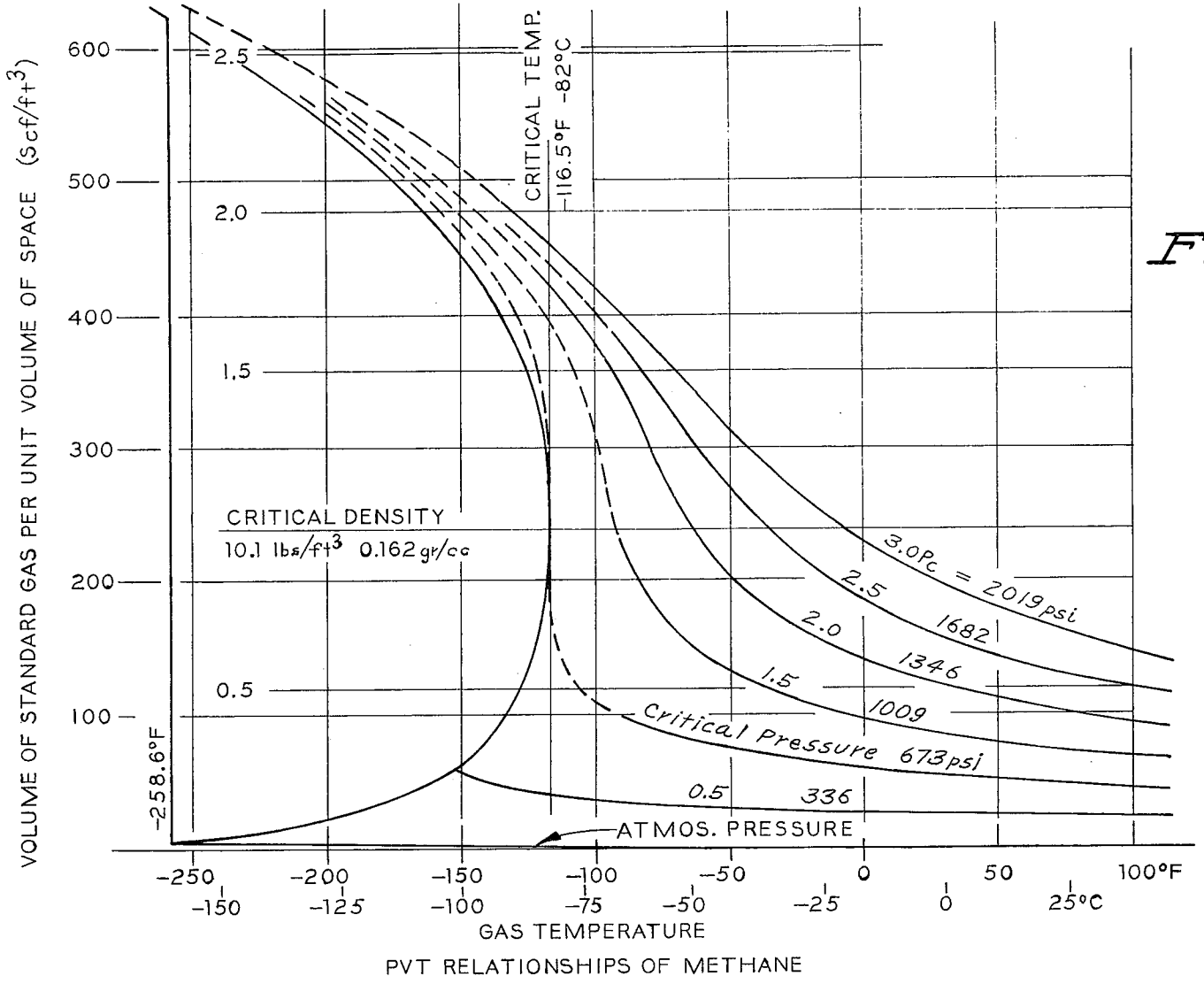
FIG. 1 is a diagram showing the number of units of standard methane gas which are contained in a space having a volume of one unit for a range of volume-pressure-temperature relationships.

Referring to the drawings, FIG. 1 shows the number of cubic feet of "standard" methane which can be stored in 1 cubic foot of space under a range of actual storage temperatures and pressures. "Standard" gas is gas at standard conditions, 60° F and 14.7 psia. Study of these curves will show advantageous conditions for the storage of gas at a maximum pressure of about 50 atmospheres and within a temperature range from about 0° to about −110° F, or perhaps a little lower to about −125° F. Storage at this moderate pressure is especially useful because generally greater storage pressures require that underground storage excavations be at greater depths, which adds to construction cost and time.

By following the curved line which shows volumes of gas at 1.25 critical pressure, which is about 840 psi or 57 atmospheres, note that at this pressure the volumes of standard gas which can be stored in each cubic foot of space are:

| | | | |
|---|---|---|---|
| at | 75° F | — | about 60 |
| at | 0° F | — | about 80 |
| at | −50° F | — | about 105 |
| at | −100° F | — | about 200 |
| at | −110° F | — | about 320 |

(The data on the chart of FIG. 1 are after Matschke, Donald E. and Thodos, George, The PVT Behavior of Methane in the Gaseous and Liquid States, Jour. of Petroleum Tech., Oct. 1960, pp. 67–71).

The solid line curves of FIG. 1 represent data in the gaseous phase. The curved dashed line through the critical point separates this from the liquid phase. Unless this dashed line is crossed, there is no change in state and only sensible heat, that needed to warm or cool the gas as such, rather than to vaporize or condense it, is involved.

One principal object of this invention is to provide a type of storage for large volumes of natural gas, LPG, methane and similar gases, which can be built and used where conventional reservoirs do not exist. Underground storage systems for the storage of gases at or near their critical temperatures and pressures afford a number of advantages as compared with other types of storage facilities which can be built at such places. Other and equally important objectives are (a) to provide an efficient way to receive gas as liquid in large quantity rapidly, as from tankers; (b) to warm a part of the gas received and send it out more or less continuously for consumption; and (c) hold other gas in dense form to meet emergency, peak or seasonal requirements.

1. The costs of construction and operation can be moderate because:

a. Many units of gas, made dense by low temperature and moderate pressure, can be stored in a unit of space without requiring the high pressures and consequent great depths that would be needed if gas were stored at ordinary temperatures. Where rock is reasonably favorable, this enables the storage excavations themselves to be made at costs favorable as compared to the heavily insulated tanks of special metals or alloys or insulated covered pits which may be used to store liquefied gas at the surface. With favorable conditions it is possible to make space for 1/5 or even 1/10 of the cost of insulated tanks. The effect of large capacity in reducing the unit cost of underground excavations is greater than in reducing those of surface storage tanks or pits.

b. Vaporizers are not needed if gas is stored as such. Where it is stored as liquid at nearly critical temperature, the work of vaporizing the liquid is less than if liquid has first to be vaporized and then warmed from the temperature of liquid storage at atmospheric pressure (about 140° F below the critical temperature.

2. The critical temperatures of these gases are such that the walls of the excavations in which they are stored are surrounded by a thick shell of rock which remains below the freezing point of water, and some other possible contaminants, as long as the storage is in use. Any moisture in rock pores and fractures is frozen, sealing any possible leakage through the rock. In the unlikely event that rock at a chosen storage locus is both permeable and dry, water or another suitable sealing material can be placed in the rock through bore-holes from the surface. As a consequence, this type of storage can be built in many locations which would be questionable or unsuited to the construction of underground excavations for the storage of gas under ordinary temperatures.

3. Like other types of deep underground gas storages, including the very useful conventional recharged natural gas reservoirs, this type of storage affords a degree of security distinctly superior to that of any storage requiring extensive plant installations and storage tanks or pits at the surface.

4. Storage can be designed for expansion of capacity without interruption of service, if and when required. Reference to FIG. 1 shows that the quantity of gas which can be stored in unit space at a temperature of 0° F (80 standard cubic feet per cubic foot of space) may be quadrupled if the storage temperature is reduced to −110° F with no significant change of pressure (840 psi). Necessary but minor facilities, such as underground piping, can be built in anticipation of the change so that the only major addition would be the installation of additional heat exchange and refrigerating equipment on the surface, or merely the addition of colder gas at higher rates or more frequently.

The choice between storing natural gas as high density gas or as liquid and gas depends on the condition of the gas as received by the owner of the storage and in view of the heat transfer characteristics of the rock at the site or sites available. When gas is received as liquid, as from tankers, and charged to storage as liquid at only a little more than atmospheric pressure and at about −260° F, the natural inflow of heat will gradually raise this temperature. While both liquid and gas exist in the storage chamber, the pressure must equal the vapor pressure of the liquid at the temperature existing. If the storage is fully charged and then shut in for a long period, pressure would have to be controlled so that the planned working pressure would not be exceeded. However, all rocks are poor conductors of heat, some indeed being rather good insulators. Normal gas withdrawals, even at low seasonal rates, may keep storage temperature undesirably low. The natural heat inflow is allowed to warm the stored liquid so that it will vaporize, or may be vaporized more readily as required for withdrawal.

Figure 2:
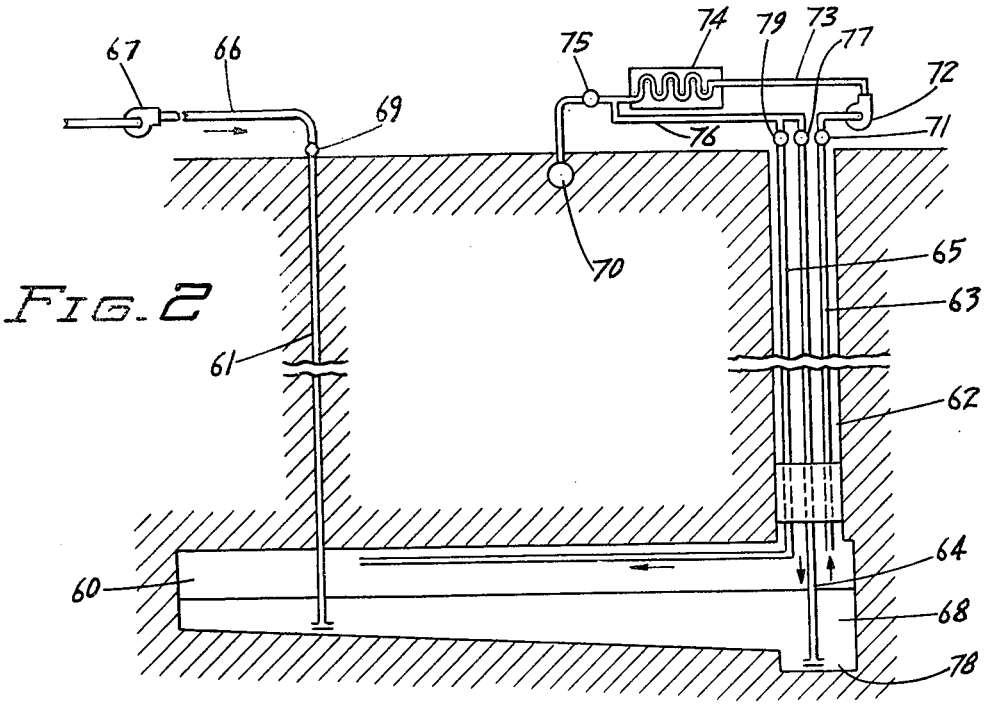
FIG. 2 is a simplified and diagrammatic sectional view of an underground storage system for the storage and temperature control of gas received liquefied at near atmospheric pressure and low temperature.

In FIG. 2, there is shown schematically a system for the storage and temperature control of gas received as liquid at nearly atmospheric pressure. The storage excavation 60 deep in the earth under at least about 1,000 feet of over-burden and rock is connected to the surface by means of an input casing or shaft 61 and a dicharge shaft 62 through which a plurality of discharge pipes 63, 64 and 65 extend. The incoming gas delivered from a marine or vehicular tanker is pumped rapidly through pipe 66 by pump 67 into the storage chamber 60 through inlet 61. Gas may exist in the chamber both in liquid form, as at 68, and in gaseous form. Inlet 61 is valved at 69.

The gas from storage is introduced for distribution to a pipeline 70. Gas in the vapor phase is withdrawn through pipe 63, which is valved at 71, by pump 72 through pipe 73 to a heat exchanger 74 where the gas is warmed, and thence to the pipeline. For temperature control of the storage chamber, valve 75 may be closed and the warmed gas from heat exchanger 74 circulated back through pipe 76 either through pipe 64, which is valved at 77 and extends to a sump 78 in the liquid phase of the stored gas, or through pipe 65, valved at 79, into the vapor phase of the storage, both for the purpose of vaporizing more liquid for circulation through pipeline 70.

The following means, singly or in combination, may be used for vaporizing gas in the storage chambers, or bringing it up to the desired storage temperature:

1. Warm methane, or any desired diluting gas is circulated into the gaseous or liquid phase. Circulation should be through all parts of the storage and preferably the direction of circulation should be reversible.

Figure 3:
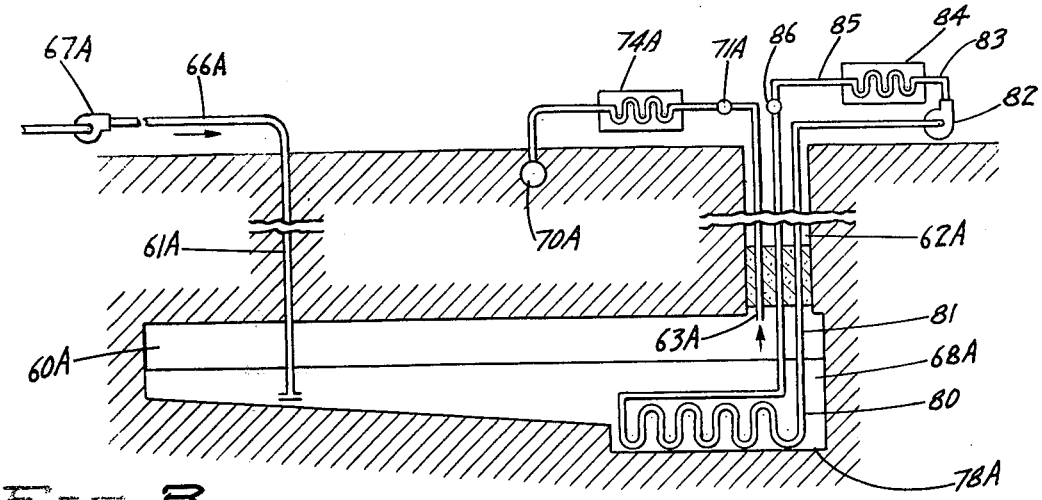
FIG. 3 shows a similar system with a warming coil in the storage chamber to gasify the stored liquid.

2. A warmed fluid from the surface is circulated through heat exchanging coils in the storage, the same coils being available for cooling, if necessary, as shown in FIG. 3.

A warming or cooling coil 80 is disposed in sump 78A in the liquid phase 68A of the stored gas in chamber 60A. The structure for the introduction of gas into the storage and withdrawal of gas from the storage is shown in somewhat simplified form as described in connection with FIG. 3 with the suffix A added to the reference numerals. Coil 80 is connected by means of a pipe 81 to pump 82 and pipe 83 to heat exchanger 84. Heat exchanger 84 may be for the purpose of either heating or cooling and is connected to coil 80 through pipe 85 and valve 86. The heating or cooling fluid, as necessary, is circulated in a closed system for heating or cooling the storage facility.

Figure 4:
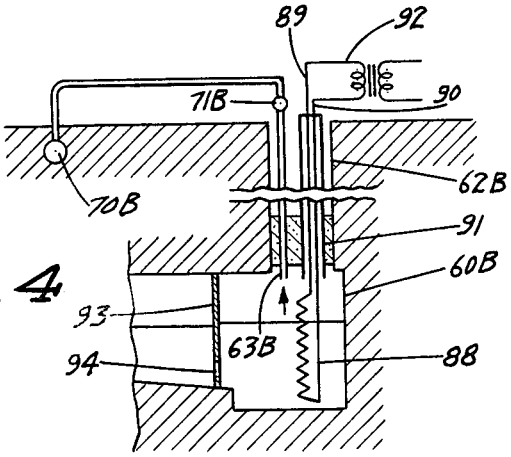
FIG. 4 is a partial sectional view showing immersion heating means in the storage chamber.

3. Electrically powered immersion heaters are placed through cased bore-holes into the liquid. As shown in FIG. 4, one or more immersion heating units 88 are disposed in the chamber 60B at least partially submerged in the liquid phase of the stored gas. Heater 88 is connected by conductors 89 and 90 extending through a closed casing 91 to an electrical heat generating source 92 at the surface.

4. To make heating most effective, its effect may be confined by baffles, as also shown in FIG. 4. Vertical baffle 93 having one or more openings 94 adjacent the floor of chamber 60B confines the heat of heater 88 to the compartment adjacent the discharge 63B to distribution pipeline 70B while still permitting inflow of colder stored gas to that compartment.

5. The pressure on the stored liquid may be reduced, thus lowering the temperature at which it vaporizes.

6. Sites may be sought in granite or other more than normally conductive rock.

7. Storage chambers may be designed to afford a high surface to volume ratio, consistent with other design conditions and to be horizontally spread to intercept more natural heat flow to the surface.

It is also possible to displace liquid methane from the storage excavations to the surface and vaporize it there. This can be done readily by pumping warm methane gas into the storage, thus increasing the pressure sufficiently to raise a column of liquid to the surface, or simply by warming the storage to increase the pressure therein. The density of methane is:

at −116° F and 45.8 atmospheres, critical temperature and pressure, specific gravity of liquid and gaseous methane is 0.162, density is 10.1 lbs. per ft.$^3$ which produces a head of 70 psi for each 1,000 feet of vertical height.

at −263° F and 1 atmosphere specific gravity of liquid methane is 0.415, the density is 25.9 lbs. per ft.$^3$ which produces a head of 180 psi for each 1,000 feet of vertical height.

The storage of large volumes of natural gas and similar substances at low capital and operating costs can be further improved by the use of the following additional means:

a. A number of separate storage chambers are provided as shown schematically in FIG. 5, which are so proportioned, oriented, disposed and so connected as to facilitate the maintenance of low temperature in a main storage chamber or chambers. A further means of cooling and maintaining low temperature in the main storage is possible by circulating cold gas or other fluid through chambers which are adjacent to but separate from the main storage chamber. This cold gas may be the exhaust from an expansion engine or other gas being expanded in preparation for sending out and the chamber through which it is sent may be below the main storage to intercept heat flowing toward the surface.

b. Pipe from each chamber is generally brought through the shafts to the surface but where convenient cased bore-holes are used which can be drilled and connected to chambers without difficulty while the storage is in use.

c. For ease of operation and servicing, control valves are placed near the surface, preferably in closed pits. For safety, excess flow valves are installed below the control valves.

d. Generally, for convenience in transferring gas, a slight pressure drop is maintained between chambers through which gas moves, though pumps or compressors can be installed for use where this may not be desirable. For most dependable delivery, pressure in the final or sendout chamber should be higher than needed to move gas into the sendout pipeline.

e. Generally, gas-retaining bulkheads are placed in shafts and to reduce the pressure difference on them, they are filled above with sand, water and sand, or gas under pressure or similar substances.

f. If incoming gas contains gases of higher boiling point than natural gas, such as LPG, which tend to liquefy and separate in the storage chamber, a small pipe and pump is provided to remove the excess periodically. However, within the range of conditions maintained in the storage, the existence of a certain amount of LPG will increase the capacity of the space to hold natural gas, which it absorbs. Either by allowing LPG to accumulate or by adding it, we have another way of increasing capacity. If any substantial amount of LPG moves through a storage system, there may be advantage in having a fractionating tower or other stripping device in the line between the first and second storage chambers as well as a separate small diameter pump column from a sump in the first chamber.

Where gas is supplied as a liquid at approximately atmospheric pressure and about −260° F, as from large tankers, these additional means are to be used:

g. The storage site is located as near as possible or practicable to deep water. This will decrease the cost of high capacity, specially built cryogenic pipeline through which tankers are unloaded and also facilitate barge shipment of stone excavated from the storage site. Beyond the storage, ordinary pipe can be used and because it can be used continuously, its hourly capacity can be much smaller.

h. Where there is objection to charging LNG directly into storage, it may be vaporized in the pipeline, sent through a grid of pipe buried in earth a few feet or submerged in a pond, sent through a coil in the storage chamber, or through a heat exchanging boiler with heat supplied from warmed gas circulated from storage.

i. A number of separate chambers are provided through which gas is circulated successively, being warmed gradually by natural heat flow, the chambers designed, oriented, connected and arranged to warm the gas most efficiently. The chambers are spread out horizontally to increase heat exchange. Chambers may be of various relative volume, usually a main storage chamber being larger than the others. For rapid warming, at least some of the chambers are of relatively shallow depth and relatively large horizontal area.

j. Natural warming is supplemented by providing heat exchangers on the surface in any part of the system.

k. A final tempering chamber is provided from which gas can be sent out to consumption with least possible conditioning.

Figure 5:
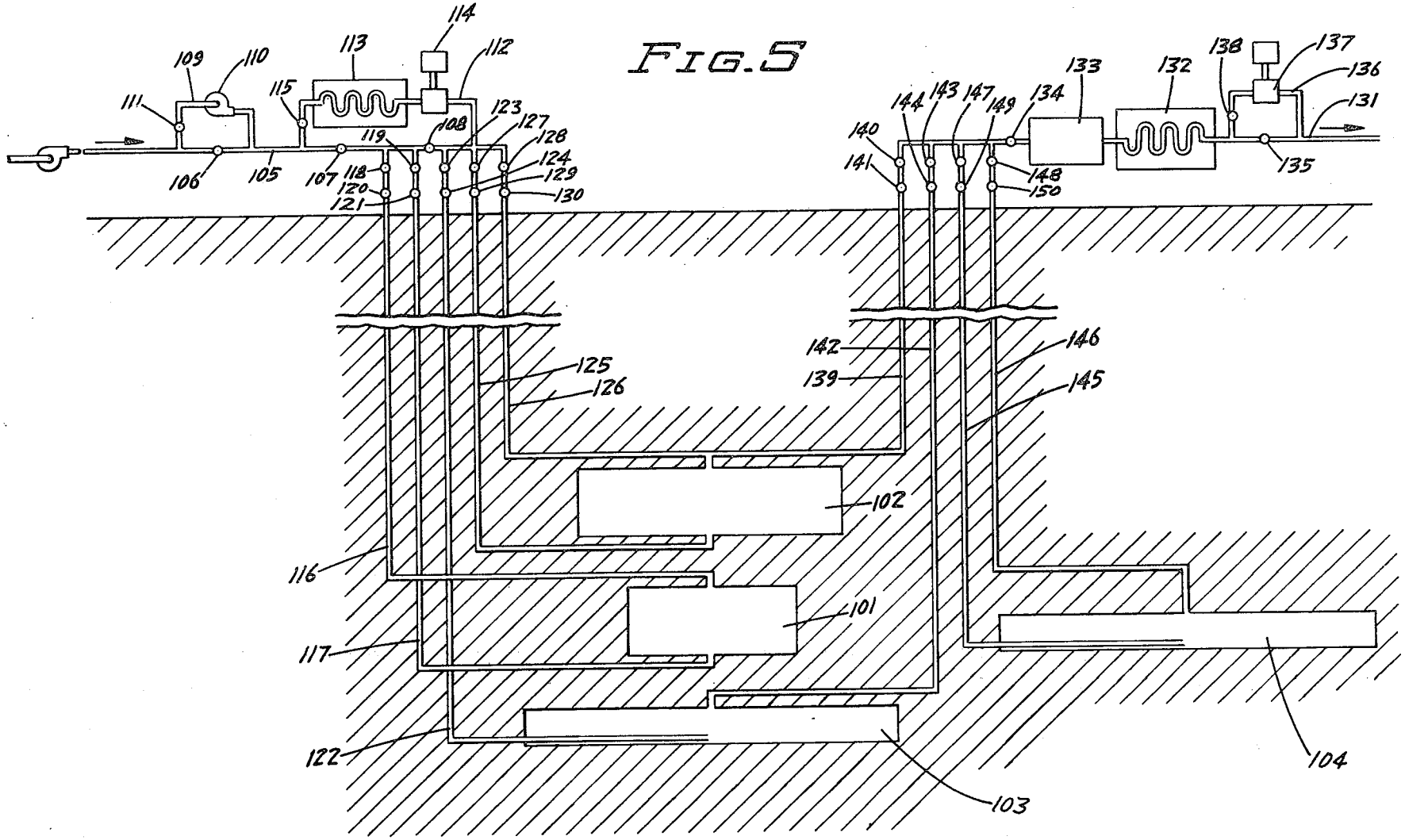
FIG. 5 is a diagrammatic sectional view of an excavated storage to receive liquefied natural gas and warm it by natural heat exchange.

Referring now to FIG. 5, there is shown diagrammetically a storage system utilizing some of the above enumerated means and especially designed to receive gas which may be still in liquid form or gas at near-critical condition for storage and to warm the gas by natural heat exchange. The excavated storage includes a plurality of spaced apart chambers 101, 102, 103 and 104. The first three of these chambers are spaced vertically one above the other so that the lower chambers shield those above from the natural flow of heat upwards. The last is spaced horizontally from the others. Chambers 103 and 104 are relatively shallow and of large area. Being separated, they receive heat equally. Liquefied gas is delivered periodically, as from tankers, for rapid unloading in line 105. Line 105 is provided with control valves 106, 107 and 108, as indicated. For use when needed, a line 109 containing pump 110 and control valve 111 is provided to facilitate delivery of the liquefied gas. A bypass line 112 including a heat exchanger 113, compressor 114 and control valve 115 is provided where, for example, it may be desired that the gas be vaporized or compressed before charging to the storage chambers. However, it may also be vaporized by natural or induced heat exchange in passing through the pipeline.

Storage chamber 101 is connected to the delivery line 105 through lines 116 and 117 fitted, respectively, with control valves 118 and 119, and preferably, for safety, with excess flow valves 120 and 121. Chamber 103 is connected with delivery line 105 by means of line 122 fitted with control valve 123 and excess flow valve 124. Chamber 102 is connected with the delivery line by lines 125 and 126 fitted, respectively, with control valves 127 and 128 and excess flow valves 129 and 130.

The gas from storage is circulated to a distribution line 131. The distribution line includes a heat exchanger 132 and, if needed, a dehydrator 133, and is fitted with control valves 134 and 135. A bypass line 136 connected to an expansion engine 137 and fitted with control valve 138 is provided for use when desirable. Chamber 102 and charging line 126 are connected with the distribution line 131 by means of line 139 fitted with control valve 140 and excess flow valve 141. Chamber 103 is connected with the distribution line through line 142 fitted with control valve 143 and excess flow valve 144. Chamber 104 is connected with the delivery-distribution system through line 131 and lines 145 and 146 fitted, respectively, with control valves 147 and 148 and excess flow valves 149 and 150. Lines 122 and 145 desirably enter chambers 103 and 104, respectively, so as to introduce cold gas near the floor. Warmer gas is removed from the top taking advantage of thermal stratification.

Ordinary routing of the liquefied gas is in sequence to chamber 101 and then to chambers 102, 103 and 104. By pumping, pressure in chamber 101 may be kept the highest. However, valving and compressors allow flexibility. For more rapid warming, chamber 102 may be spaced horizontally from chamber 101 instead of vertically.

Various alternative procedures are possible. The liquefied natural gas may be pumped directly to chambers 101, 102 or 103 or the heat exchanger 113 and compressor 114 and then to chambers 101, 102 or 103. Gas from chamber 101 may be drawn directly to chamber 102 or to chamber 103. Gas from chamber 101 may be transferred directly or through the heat exchanger-compressor to chambers 102 or 103 or returned to chamber 101. Gas from chambers 102 and 103 may be transferred to the dehydrator 133, heat exchanger 132 and expansion engine 137 to distribution to a distribution system or gas from chambers 102 or 103 may be transferred to chamber 104. Gas from chamber 104 may be transferred to the dehydrator-heat exchanger-expansion engine to distribution.

The specific design of each storage least will be determined by local conditions and requirements. In general, each facility will include provision to pump liquefied gas from a tanker into a cryogenic pipeline designed to deliver gas in liquid or gaseous state at the storage at about the temperature and perhaps the pressure desired. Generally, each facility will include several chambers interconnected by pipe reaching to the surface so that gas can be routed through the chambers more or less serially as desired. Pressure generally decreases between successive chambers. Temperature increases progressively through successive chambers, although the precise routing can be varied as may be most efficient under the particular circumstances of receipt and delivery of gas.

The needed degree of storage capacity is maintained and wasteful fuel consumption is minimized by various heat exchanging procedures utilizing incoming, outgoing and stored gas passed through heat exchangers on the surface. Incoming cold gas may be warmed and at the same time gas in storage may be cooled by circulating both through the same heat exchanger. Stored gas may be cooled by circulating colder incoming gas through a pipe coil in a chamber, or through an adjacent but separate chamber, or by introducing the colder gas directly into the chamber to be cooled. Stored gas may be cooled by expansion before sending it out for use in an expansion motor or otherwise, or by circulating it through a heat exchanger on the surface, or by circulating the expanded gas through a pipe coil in a cooler chamber or through an adjacent but separate chamber of cooler gas underground.

By use of the various means indicated, the effective capacity of an existing storage facility may be increased by reducing its working temperature. This can be accomplished automatically since, as the volume of cold gas fed into the storage is increased, the storage temperature will decrease, unless the rate of heat supplied is increased correspondingly.

It is apparent that many modifications and variations of this invention as hereinbefore set forth may be made without departing from the spirit and scope thereof. The specific embodiments described are given by way of example only and the invention is limited only by the terms of the appended claims.

TABLE I

CRITICAL DATA FOR VARIOUS GASES[1]

| | | Crit. Temp. °F | Crit. Pres. Atmos. | Crit. Vol. Cu.Ft./per lb. | Std.[2] Vol. Cu.Ft./per lb. | Ratio Std. Vol./Crit.Vol. |
|---|---|---|---|---|---|---|
| Argon | | − 187.7 | 48.0 | 0.03 | 9.50 | 317 |
| Carbon Monoxide, 00 | | − 220.3 | 34.5 | 0.053 | 13.57 | 256 |
| Hydrogen | | − 399.8 | 12.8 | 0.516 | 188.6 | 365 |
| Methane, $CH_4$ | | − 116.5 | 45.8 | 0.099 | 23.6 | 239 |
| Nitrogen | | − 232.8 | 33.5 | 0.053 | 13.57 | 256 |
| Nitric Oxide, NO | | − 136.7 | 65.0 | 0.031 | 12.66 | 408 |
| Oxygen | | − 181.8 | 49.7 | 0.037 | 11.87 | 320 |
| Air | | − 220.3 | 37.2 | 0.0457 | 13.08 | 286 |
| Natural Gas[3] | 1 | − 87.4 | | | 46.1 | |
| | 2 | − 96.3 | | | 45.7 | |
| | 3 | − 118.6 | | | 45.3 | |

[1]Marks, Mech. Engrs. Handbook, 6th Ed., pp 4–20, 4–28, and Amer. Gas Jour. Handbook 1958, p. 60–61
[2]At 60° F and 14.7 psia
[3]These are "pseudo critical" values calculated for mixtures considered representative of natural gas The embodiments of the invention in which an exclusive property or privilege is claimed are defined as follows:

1. A method of storage and tempering of large volumes of compressed gas received as a cryogenic liquid in an underground storage facility deep in the earth including at least one underground rock chamber, which method comprises:

A. receiving liquefied gas at about −260° F and at about atmospheric pressure into a cryogenic pipeline for charging to said storage facility, B. introducing heat into said storage facility to warm the gas therein, C. maintaining the storage facility at a temperature between about 0° F to about −110° F and moderately elevated pressure up to about 2500 psi to maintain the gas predominantly in the gaseous state to store between about 75 and 475 cubic feet of gas to each cubic foot of storage space, D. withdrawing gas from said storage facility for consumption as needed, E. heating said withdrawn gas to between about 32° F and −40° F, and F. discharging the warmed gas to a pipeline for distribution.

2. A method according to claim 1 further characterized in that stored gas is circulated to heat exchangers at ground surface to maintain the storage temperature.

3. A method according to claim 1 further characterized in that the storage temperature is maintained by circulation of a heat exchanging fluid through the storage chamber out of contact with the stored gas.

4. A method according to claim 1 further characterized in that said liquefied gas is at least partially vaporized by heat exchange at ground surface and then charged to storage.

5. A method according to claim 4 further characterized in that said liquefied gas is at least partially vaporized at ground surface by passing the liquefied gas in heat exchanging relation with stored gas circulated to the surface.

6. A method according to claim 1 further characterized in that:

A. said storage facility comprises at last one storage chamber and a plurality of other chambers adjacent to but separated from said storage chamber, and B. the storage temperature is maintained within said storage chamber by circulating a heat exchanging fluid through said other chambers.

7. A method according to claim 1 further characterized in that said storage facility includes at least one horizontally disposed rock chamber of relatively shallow depth and relatively large area and horizontal extension whereby the stored gas is exposed to maximum natural heat flow for rapid warming of the gas.

8. A method according to claim 1 further characterized in that said storage facility includes a plurality of underground rock chambers each interconnected by flow lines extending to the ground surface.

9. A method according to claim 1 further characterized in that said storage facility includes a main storage chamber of relatively larger volume and a plurality of other chambers of relatively smaller volume.

10. A method according to claim 1 further characterized in that:

A. said storage facility comprises a plurality of storage chambers connected in series, and B. the pressure in each of said chambers downstream from the first chamber is maintained at a level lower than the pressure in the next adjacent upstream chamber and the temperature in each of said chambers downstream from the first chamber is maintained at a level higher than the temperature of the next adjacent upstream chamber.

11. A method according to claim 1 further characterized in that:

A. said storage facility comprises a plurality of horizontally spaced apart storage chambers connected in series, and B. said gas is warmed by natural heat flow by circulating said gas successively from chamber to chamber.

12. A method according to claim 1 further characterized in that:

A. said storage facility comprises a plurality of vertically spaced storage chambers connected in series, and B. said gas is warmed by natural heat flow by circulating the gas successively from chamber to chamber.

13. A method according to claim 12 further characterized in that:

A. said storage facility includes at least one storage chamber spaced horizontally from said vertically spaced chambers and connected in series therewith, and B. said gas is circulated successively from said vertically spaced chambers to said horizontally spaced chamber.

14. A method according to claim 1 further characterized in that:

A. said gas to be stored is natural gas,

B. a small amount of liquefied petroleum gas (LPG) is maintained in said storage chamber, and C. a portion of said natural gas is absorbed in said LPG, thereby increasing the capacity of said chamber.

15. A method according to claim 1 further characterized in that the storage temperature is maintained by introducing at least a portion of said gas to storage in liquid form.

* * * * *

UNITED STATES PATENT AND TRADEMARK OFFICE

CERTIFICATE OF CORRECTION

PATENT NO. : 3,950,958

DATED : April 20, 1976

INVENTOR(S) : Robert L. Loofbourow

It is certified that error appears in the above–identified patent and that said Letters Patent are hereby corrected as shown below:

Column 1, line 59, "rates" should be --rate--.

Column 2, line 48, "diasters" should be --disasters--.

Column 8, line 30, "least" should be --facility--.

Column 9, Claim 6, line 3, "last" should be --least--.

Signed and Sealed this

Thirty-first Day of August 1976

[SEAL]

*Attest:*

RUTH C. MASON
*Attesting Officer*

C. MARSHALL DANN
*Commissioner of Patents and Trademarks*